US010006285B2

(12) United States Patent
Kuramoto

(10) Patent No.: US 10,006,285 B2
(45) Date of Patent: Jun. 26, 2018

(54) TUNNEL BORING DEVICE, AND CONTROL METHOD THEREFOR

(71) Applicant: KOMATSU LTD., Tokyo (JP)

(72) Inventor: Toyoshi Kuramoto, Katano (JP)

(73) Assignee: KOMATSU LTD., Tokyo (JP)

( * ) Notice: Subject to any disclaimer, the term of this patent is extended or adjusted under 35 U.S.C. 154(b) by 133 days.

(21) Appl. No.: 15/022,996

(22) PCT Filed: Nov. 5, 2014

(86) PCT No.: PCT/JP2014/079331

§ 371 (c)(1),
(2) Date: Mar. 18, 2016

(87) PCT Pub. No.: WO2015/079877

PCT Pub. Date: Jun. 4, 2015

(65) Prior Publication Data

US 2016/0230552 A1 Aug. 11, 2016

(30) Foreign Application Priority Data

Nov. 29, 2013 (JP) ..... 2013-247695

(51) Int. Cl.
*E21D 9/11* (2006.01)
*E21D 9/00* (2006.01)
*E21D 9/10* (2006.01)

(52) U.S. Cl.
CPC ..... *E21D 9/003* (2013.01); *E21D 9/108* (2013.01); *E21D 9/1093* (2013.01); *E21D 9/11* (2013.01); *E21D 9/112* (2013.01)

(58) Field of Classification Search
CPC ..... E21D 9/003; E21D 9/108; E21D 9/1093; E21D 9/11; E21D 9/112
(Continued)

(56) References Cited

U.S. PATENT DOCUMENTS 4,548,443 A * 10/1985 Turner ..... E21D 9/1093 299/31
6,206,478 B1 * 3/2001 Uehara ..... E21C 27/24 299/33
2012/0230771 A1 * 9/2012 Farley ..... B23P 19/02 405/184

FOREIGN PATENT DOCUMENTS

CN 1584290 A 2/2005
JP 60-119896 A 6/1985
(Continued)

OTHER PUBLICATIONS

The Office Action for the corresponding Japanese application No. 2013-247695 dated Aug. 1, 2017.
(Continued)

*Primary Examiner* — David J Bagnell
*Assistant Examiner* — Michael A Goodwin
(74) *Attorney, Agent, or Firm* — Global IP Counselors, LLP

(57) ABSTRACT

A boring machine comprises a forward section, a rear section, a parallel link mechanism, stroke sensors, pressure sensors, and a controller. The parallel link mechanism includes eight thrust jacks that change the position and attitude of the forward section with respect to the rear section. The controller computes a target allocation force to be allocated to eight thrust jacks on the basis of the sensing result from the stroke sensors and the pressure sensors, and controls the thrust jacks to perform stroke control on six of the thrust jacks and perform force control on two of the thrust jacks.

15 Claims, 9 Drawing Sheets

(58) Field of Classification Search
USPC ..... 299/1.8
See application file for complete search history.

(56) References Cited

FOREIGN PATENT DOCUMENTS

| | | | |
|---|---|---|---|
| JP | 60-119897 | A | 6/1985 |
| JP | 6-101394 | A | 4/1994 |
| JP | 9-88481 | A | 3/1997 |
| JP | 9-184394 | A | 7/1997 |
| JP | 10-131664 | A | 5/1998 |
| JP | 2001-311389 | A | 11/2001 |
| JP | 2003-262521 | A | 9/2003 |

OTHER PUBLICATIONS

The International Search Report for the corresponding international application No. PCT/JP2014/079331, dated Dec. 22, 2014.
The Office Action for the corresponding Chinese application No. 201480049387.8, dated Apr. 27, 2017.

* cited by examiner

TUNNEL BORING DEVICE, AND CONTROL METHOD THEREFOR

CROSS-REFERENCE TO RELATED APPLICATIONS

This application is a U.S. National stage application of International Application No. PCT/JP2014/079331, filed on Nov. 5, 2014. This U.S. National stage application claims priority under 35 U.S.C. § 119(a) to Japanese Patent Application No. 2013-247695, filed in Japan on Nov. 29, 2013, the entire contents of which are hereby incorporated herein by reference.

BACKGROUND OF

Field of the Invention

The present invention relates to a tunnel boring device used in the excavation of a tunnel, and to a method for controlling this device.

Background Information

The excavation of a tunnel is performed using a boring machine equipped with a cutter head including a cutter at the front of the machine, and grippers provided on the left and right sides at the rear of the machine.

This boring machine excavates the tunnel by pressing the rotating cutter head against the working face in a state in which the left and right grippers have been pressed against the left and right side walls of the tunnel.

Japanese Laid-Open Patent Application H10-131664, for example, discloses a control device and a method for controlling a redundant parallel link mechanism equipped with jacks that exceed the number of degrees of freedom, wherein the proper control can be performed even if the number of control devices is reduced.

With this redundant parallel link control device, eight or more thrust jacks are provided to give redundancy to position and direction control of the forward section while resisting external force during excavation, and stroke control hydraulic circuits are provided to six of these thrust jacks. With the remaining thrust jacks, the pushing side and pulling side thereof are made to communicate with the hydraulic circuits on the pushing side and pulling side of the thrust jacks that are stroke controlled. This reduces the size of the control hydraulic devices.

SUMMARY

Nevertheless, the following problem is encountered with the conventional tunnel boring device discussed above.

When the tunnel boring device disclosed in the above-mentioned publication is used for shaft boring, for example, it is necessary to perform three-dimensional curve excavation with a smaller radius of curvature R than in ordinary tunnel excavation.

In particular, when excavating a tunnel along a sharp curve with a small radius of curvature R, the various thrust jacks are all subjected to different thrust forces, radial forces, and torque, and these values fluctuate greatly. Accordingly, with a device in which the hydraulic circuits of two particular jacks are made to communicate, the direction and magnitude of the force exerted on these two jacks are different, and it may be impossible to control the axial force of the jacks properly.

It is an object of the present invention to provide a tunnel boring device that can properly handle external forces of all directions and magnitudes produced during tunnel excavation, as well as a method for controlling this device.

The tunnel boring device pertaining to a first exemplary embodiment of the present invention comprises a forward section, a rear section, a parallel link mechanism, stroke sensors, force sensors, and a controller. The forward section has a plurality of cutters at the excavation-side surface. The rear section is disposed to the rear of the forward section and has grippers for obtaining counterforce during excavation. The parallel link mechanism includes (6+n) thrust jacks that are disposed in parallel between the forward section and the rear section, link the forward section and the rear section, and change the position and attitude of the forward section with respect to the rear section (where n=1, 2, 3, 4, 5, . . . ). The stroke sensors are attached to the thrust jacks to sense the amounts of stroke of the thrust jacks. The force sensors are attached to the thrust jacks to sense the load to which the thrust jacks are subjected. The controller computes a target allocation force to be allocated to the (6+n) thrust jacks on the basis of the sensing results of the stroke sensors and the force sensors, and controls the thrust jacks so that stroke control will be performed for six of the thrust jacks, and force control involving the allocation force will be performed for the other n number of thrust jacks (n is a natural number).

Here, with a tunnel boring device that excavates a tunnel by moving a forward section with respect to a rear section by means of a parallel link mechanism that includes (6+n) thrust jacks provided between the forward section and the rear section, stroke control is performed for six of the thrust jacks, and force control is performed for the remaining n number of thrust jacks, on the basis of the sensing results from the stroke sensors and the force sensors attached to the thrust jacks.

To perform tunnel excavation three-dimensionally, the position and direction of the forward section require six degrees of freedom in the rotation around the three axes (X, Y, and Z) of an orthogonal coordinate system, so six-axial drive links (thrust jacks) are necessary. With the present invention, a parallel link mechanism that includes (6+n) thrust jacks is used, with n number of additional thrust jacks, to resist the large external forces encountered during tunnel excavation.

In general, with a mechanism having six degrees of freedom, it is possible to control position and attitude by stroke control with multi-axial drive links greater than six-axial, but error inevitably occurs in stroke computation. Furthermore, since there is internal pressure that is cancelled out in the interior of the drive links, the performance of the drive links suffers. Even when stroke control is performed for six of the thrust jacks and external force is resisted complementarily by the other n number of thrust jacks, when the tunneling involves sharp curves, or when there are large swings in torque or propulsion, with the simple communicating hydraulic circuits discussed above, internal pressure is conversely generated in the jacks, and the maximum external force that can be resisted by the thrust jacks may in some cases be small.

With the present invention, the position and attitude of the forward section are controlled by performing stroke control on six of the thrust jacks. The external force calculated on the basis of the load to which the (6+n) thrust jacks are subjected is allocated to the (6+n) thrust jacks, and force control is performed on the remaining n number of thrust jacks depending on the allocated force. Consequently, external force can be ideally allocated to the (6+n) jacks, and the force of each of the jacks can be more effectively exerted on the outside of the links.

The tunnel boring device pertaining to a second exemplary embodiment of the present invention is the tunnel boring device pertaining to the first exemplary embodiment of the present invention, wherein the controller computes the external force to which the forward section is subjected on the basis of the stroke amounts for the six thrust jacks and the load to which the (6+n) thrust jacks are subjected as sensed by the force sensors, and computes the target allocation force for each of the thrust jacks in order to resist this external force.

Here, the controller computes the external force to which the forward section is subjected from the sensed stroke amounts of the thrust jacks and the load that is exerted. It then computes the load that each thrust jack should receive from the computed external force, and this is used as the target allocation force.

Consequently, the value for the controlled force can be properly computed for the n number of thrust jacks that are force controlled.

The tunnel boring device pertaining to a third exemplary embodiment of the present invention is the tunnel boring device pertaining to the first or second exemplary embodiments of the present invention, wherein force sensors are provided to (6+n) of the thrust jacks, and stroke sensors are provided to six of the thrust jacks.

Here, stroke sensors and force sensors are attached to the six thrust jacks that undergo stroke control, and only force sensors are attached to the n number of thrust jacks that undergo only force control.

Consequently, the minimum number of sensors can be used to perform the above-mentioned stroke control and force control.

The tunnel boring device pertaining to a fourth exemplary embodiment of the present invention is the tunnel boring device pertaining to any of the first to third exemplary embodiments of the present invention, wherein (6+n) of the thrust jacks are disposed in a substantially circular pattern around the outer peripheral portion of the faces where the forward section and the rear section are opposite each other.

Here, the ends of the (6+n) thrust jacks on the piston rod side and the cylinder tube side are disposed in a substantially circular pattern around the outer peripheral portion of the faces where the forward section and the rear section are opposite each other. This allows numerous thrust jacks to be disposed with good balance.

The tunnel boring device pertaining to a fifth exemplary embodiment of the present invention is the tunnel boring device pertaining to any of the first to fourth exemplary embodiments of the present invention, wherein the controller controls each of the thrust jacks to control the attitude of the forward section three-dimensionally.

Here, the thrust jacks included in the parallel link mechanism are controlled to allow the orientation and attitude of the forward section with respect to the rear section to be adjusted three-dimensionally (up, down, left, and right). This makes it easy to bore out shafts, including tunnels, in three dimensions, including curved portions, for example.

The tunnel boring device pertaining to a sixth exemplary embodiment of the present invention is the tunnel boring device pertaining to any of the first to fifth exemplary embodiments of the present invention, further comprising an input component that receives control inputs related to the movement direction of the forward section from an operator. When the input component receives a control input from the operator, the controller controls six of the thrust jacks so that excavation will be performed along the desired radius R set on the basis of this control input.

Here, six of the thrust jacks are controlled by control inputs from the operator so that curved portions will be excavated along the desired radius of curvature R. This allows excavation to be performed along a smooth curve while maintaining the desired radius of curvature R, using a single control input from the operator.

The tunnel boring device pertaining to a seventh exemplary embodiment of the present invention is the tunnel boring device pertaining to the sixth exemplary embodiment of the present invention, wherein the input component is a touch panel type of monitor.

Here, a touch panel monitor is used as the input component that receives control inputs from the operator. This allows the operator to easily perform excavation in the desired direction merely by operating the touch panel monitor when adjusting the movement direction of the forward section by manual operation.

The tunnel boring device pertaining to an eighth exemplary embodiment of the present invention is the tunnel boring device pertaining to the seventh exemplary embodiment of the present invention, wherein the monitor has directional keys for setting the movement direction of the forward section, and a display component for displaying the relative position of the forward section with respect to the rear section.

Here, the touch panel monitor displays directional keys for setting the movement direction of the forward section, and the relative position of the forward section with respect to the rear section.

This allows the operator to easily perform excavation in the desired direction merely by intuitively pressing the directional key in which fine adjustment is needed.

The method for controlling a tunnel boring device pertaining to a ninth exemplary embodiment of the present invention is a method for controlling a tunnel boring device comprising a forward section having a plurality of cutters on the excavation-side surface, a rear section that is disposed to the rear of the forward section and has grippers for obtaining counterforce during excavation, and a parallel link mechanism that includes (6+n) thrust jacks that link the forward section and the rear section and change the position of the forward section with respect to the rear section, said method comprising the steps of sensing the load to which the thrust jacks are subjected, sensing the stroke amounts of the thrust jacks, calculating the external force to which the forward section is subjected on the basis of the sensed stroke amounts and the load to which the thrust jacks are subjected, calculating a target allocation force allocated to the (6+n) thrust jacks on the basis of the external force, and controlling the thrust jacks so stroke control will be performed for six of the thrust jacks, and force control involving the target allocation force will be performed for the other n number of thrust jacks.

Here, with a tunnel boring device in which a tunnel is excavated by making the forward section move forward with respect to the rear section by means of a parallel link mechanism that includes (6+n) thrust jacks provided between the forward section and the rear section, six of the thrust jacks are subjected to stroke control, and the remaining n number of thrust jacks are subjected to force control, on the basis of the sensing results from force sensors and stroke sensors attached to the various thrust jacks.

To perform tunnel excavation three-dimensionally, the position and direction of the forward section require six degrees of freedom in the rotation around the three axes (X, Y, and Z) of an orthogonal coordinate system, so six-axial drive links (thrust jacks) are necessary. With the present invention, a parallel link mechanism that includes (6+n) thrust jacks is used, with n number of additional thrust jacks, to resist the large external forces encountered during tunnel excavation.

With the exemplary embodiments of the present invention, the position and direction of the forward section are controlled by subjecting six of the thrust jacks to stroke control. Furthermore, external force calculated on the basis of the load to which the (6+n) thrust jacks are subjected is allocated to the (6+n) thrust jacks, and force control is performed on the remaining n number of thrust jacks depending on the allocated force. Consequently, external force can be ideally allocated to the (6+n) jacks, and the force of each of the jacks can be more effectively exerted on the outside of the links.

Consequently, stroke control, which entails less error, is performed for six of the thrust jacks, and a larger external force can be resisted than with a parallel link mechanism equipped with just six thrust jacks. As a result, (6+n) thrust jacks can be used to properly handle even situations in which there is fluctuation in the direction and magnitude of the external force exerted on a tunnel boring device in the excavation of curved parts that include a small radius of curvature, for example.

With the tunnel boring device pertaining to the exemplary embodiments of the present invention, being a tunnel boring device equipped with a parallel link mechanism that includes (6+n) thrust jacks, force control can be performed on thrust jacks at the proper load even when excavating a sharp curve.

DETAILED DESCRIPTION OF THE EXEMPLARY EMBODIMENTS

The tunnel boring device and its control method pertaining to an exemplary embodiment of the present invention will now be described through reference to FIGS. 1 to 8.

The boring machine (tunnel boring device) 10 in this exemplary embodiment (FIG. 1, etc.) is an excavation device used in shaft boring (see FIG. 7), and is called a TBM (tunnel boring machine), or more precisely, a gripper TBM or a hard rock TMB. Also, in this exemplary embodiment, the tunnel (first tunnel T1) excavated by the boring machine 10 has a substantially circular cross section (see the first tunnel T1 in FIG. 2). The cross sectional shape of the tunnel excavated by the boring machine 10 pertaining to this exemplary embodiment is not limited to being circular, and may instead be elliptical, double circular, horseshoe shaped, or the like.

Configuration of Boring Machine 10

Figure 1:
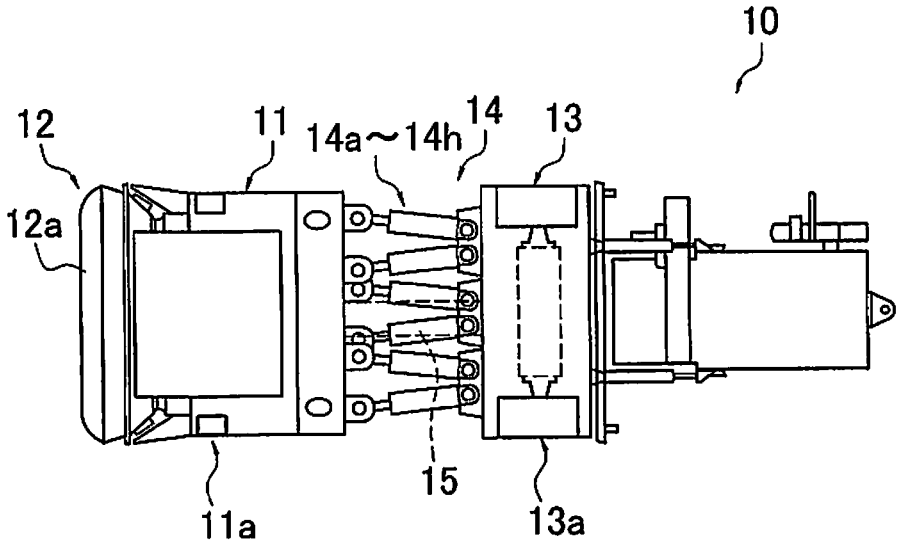
FIG. 1 is an overall view of the configuration of the tunnel boring device pertaining to an exemplary embodiment of the present invention.

In this exemplary embodiment, the excavation of the first tunnel T1 (see FIG. 2, etc.) was performed using the boring machine 10 shown in FIG. 1. The boring machine 10 described in this exemplary embodiment has an ordinary configuration for performing excavation by rotating a cutter head 12 while supported to the rear by grippers 13*a*.

The boring machine 10 is a device used to excavate a first tunnel T1 by moving forward while cutting a rock, etc., and as shown in FIG. 1, comprises a forward section 11, a cutter head 12, a rear section 13, a parallel link mechanism 14, and a conveyor belt 15.

Figure 2:
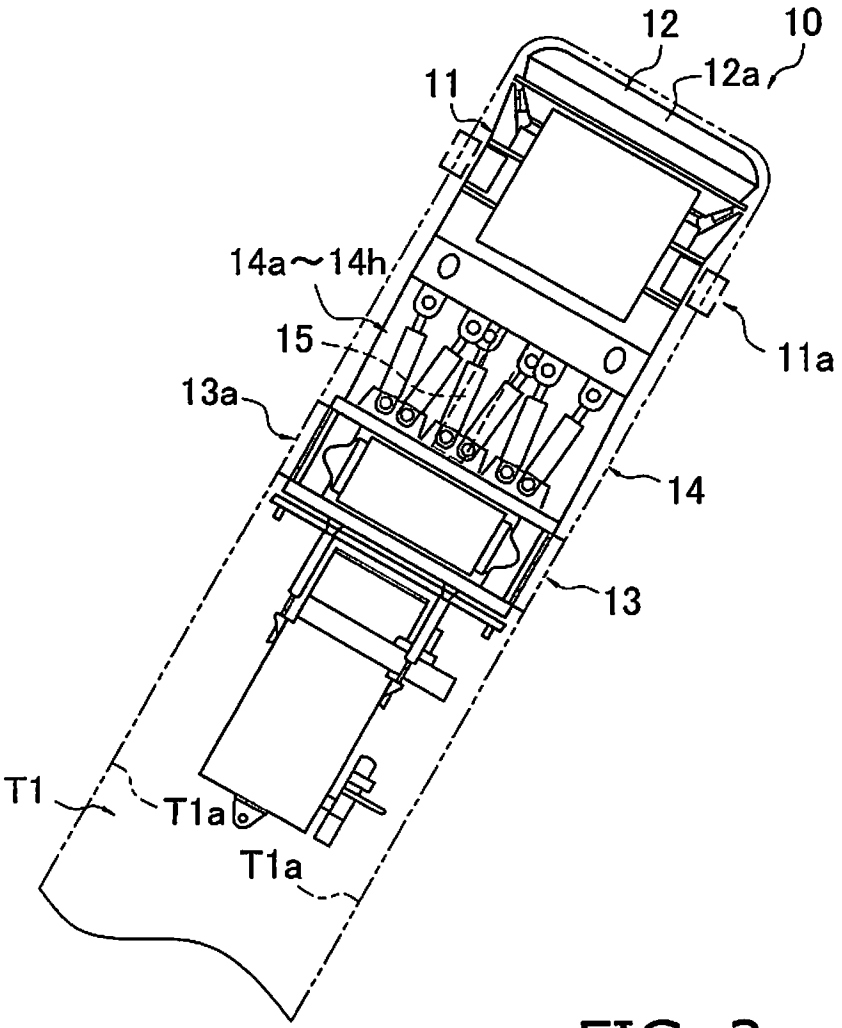
FIG. 2 is a cross section of a state in which the boring machine in FIG. 1 is used to perform tunnel excavation.

As shown in FIG. 1, the forward section 11 is disposed between the cutter head 12 and the parallel link mechanism 14, and constitutes the front part of the boring machine 10 along with the cutter head 12 provided to the distal end on the excavation side. The position and attitude of the forward section 11 with respect to the rear section 13 are changed by a plurality of thrust jacks 14*a* to 14*h* included in the parallel link mechanism 14 (discussed below). As shown in FIG. 2, the forward section 11 also has grippers 11*a* that protrude from the outer faces of the forward section 11 and are pressed against side walls T1*a* of the tunnel T1. Consequently, when the boring machine 10 is reversed, for example, the forward section 11 is supported within the tunnel T1 while driven in the direction in which the parallel link mechanism 14 is extended, which allows the rear section 13 to be reversed.

As shown in FIG. 1, the cutter head 12 is disposed on the distal end side of the boring machine 10, and is rotated such that its rotational center is the center axis of the substantially circular tunnel, and rock, etc., is excavated by a plurality of disk cutters 12*a* provided to the surface on the distal end side. Rocks, stones, and the like that have been finely crushed by the disk cutters 12*a* are brought into the interior of the cutter head 12 through openings (not shown) formed in the surface.

As shown in FIG. 1, the rear section 13 is disposed on the rear side of the boring machine 10, and constitutes the rear part of the boring machine 10. Grippers 13*a* are provided on both sides of the rear section 13 in the width direction. The rear section 13 and the forward section 11 are linked by the parallel link mechanism 14.

As shown in FIG. 2, the grippers 13*a* protrude outward in the radial direction from the outer faces of the rear section 13, and are thereby pressed against the side walls T1*a* of the first tunnel T1 during excavation. This allows the boring machine 10 to be supported within the first tunnel T1.

As shown in FIG. 1, the parallel link mechanism 14 is disposed in the middle of the boring machine 10 in the longitudinal direction, and constitutes the middle section of the boring machine 10. The parallel link mechanism 14 has eight (6+n, where n=2) thrust jacks 14*a* to 14*h*. The thrust jacks 14*a* to 14*h* are cylindrical hydraulic actuators. The thrust jacks 14*a* to 14*h* are disposed in parallel between the forward section 11 and the rear section 13, and link the forward section 11 to the rear section 13. Accordingly, the first tunnel T1 is excavated by the cutter head 12 in a state in which the thrust jacks 14*a* to 14*h* are extended and retracted between the forward section 11 and the rear section 13 so that the attitude (orientation) of the forward section 11 with respect to the rear section 13 is controlled to the desired direction while resisting external force.

The thrust jacks 14*a* to 14*h* are driven by a hydraulic pump 52 with bi-directional discharge. The hydraulic pump 52 is driven by a servo motor 51. The servo motor 51 is controlled by a signal outputted from a controller 20. The servo motor 51 controls the extension, retraction, and stopping of the thrust jacks 14*a* to 14*h*.

The control over the thrust jacks 14*a* to 14*h* includes stroke control and force control. With stroke control, when the stroke amounts of the thrust jacks are designated, the controller 20 extends or retracts the thrust jacks by those stroke amounts, and stops the jacks at those stroke amounts. With force control, when the load value to which the jacks are subjected is designated, the controller increases the stroke amounts while the load to which the thrust jacks are subjected is less than this load value, and maintains the state when the load is equal to the load value.

Figure 3:
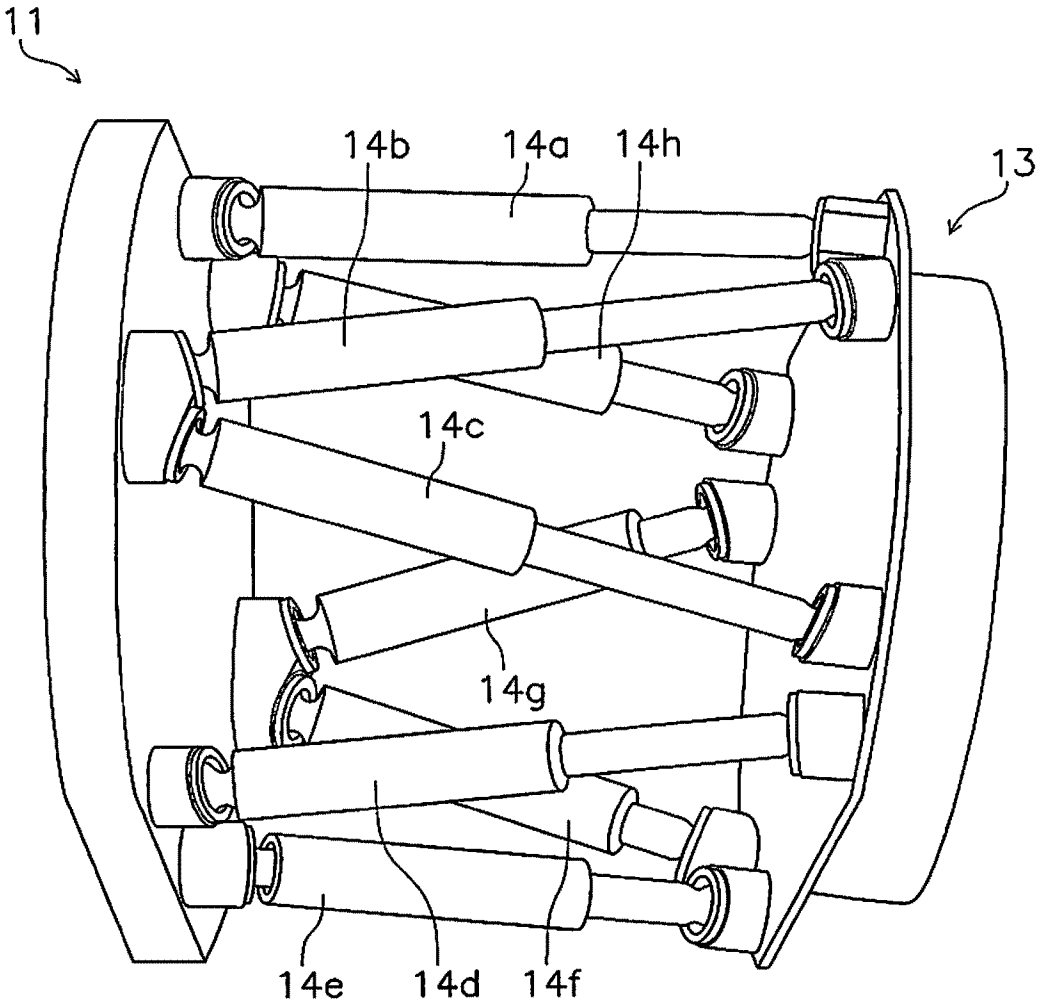
FIG. 3 is a simplified diagram of the layout configuration of the thrust jacks included in the parallel link mechanism installed in the boring machine in FIG. 1.

As shown in FIG. 3, the cylinder tube side and the piston rod side of the eight thrust jacks 14*a* to 14*h* are disposed in a substantially circular pattern around the outer peripheral portions of the opposite faces of the forward section 11 and the rear section 13. Of the eight thrust jacks 14*a* to 14*h*, the six thrust jacks 14*a* to 14*f* that will undergo stroke control are extended or retracted to move the forward section 11 forward with respect to the rear section 13, or to reverse the rear section 13 with respect to the forward section 11, thereby allowing the boring machine 10 to be moved forward or backward a little at a time.

Pressure sensors 17*a* to 17*h* (see FIG. 4), which are force sensors that sense the cylinder pressure of the thrust jacks 14*a* to 14*h*, are attached to the eight thrust jacks 14*a* to 14*h*. Also, as shown in FIG. 5A, stroke sensors 16*a* to 16*f* that sense the stroke amounts of the thrust jacks 14*a* to 14*f* are attached to the six thrust jacks 14*a* to 14*f* that undergo stroke control.

Figure 5B:
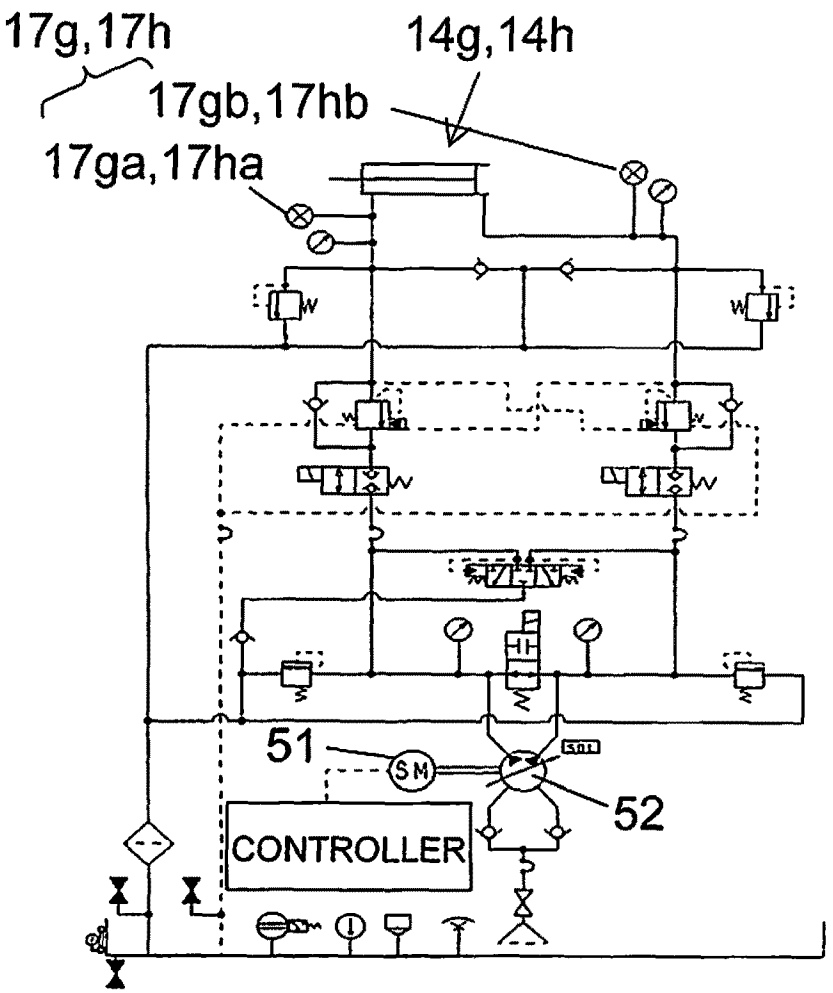
FIG. 5B is a circuit diagram of a thrust jack, used to perform the allocation force control shown in FIG. 4.

That is, in this exemplary embodiment, of the eight thrust jacks 14*a* to 14*h* included in the parallel link mechanism 14, only the pressure sensors 17*g* and 17*h* are attached as shown in FIG. 5B to the two thrust jacks 14*g* and 14*h* that do not undergo stroke control, and no stroke sensors are attached to these jacks.

The eight thrust jacks 14*a* to 14*h* are controlled by a jack controller 26 (discussed below) on the basis of the sensing results from the stroke sensors 16*a* to 16*f* and the pressure sensors 17*a* to 17*h*.

The stroke control and force control of the thrust jacks 14*a* to 14*h* by the jack controller 26 will be discussed in detail at a later point.

As shown in FIG. 5A, the stroke sensors 16*a* to 16*f* are attached to the six thrust jacks 14*a* to 14*f* that undergo stroke control. As mentioned above, no stroke sensors are attached to the two thrust jacks 14*g* and 14*h* that do not undergo stroke control.

This allows the stroke amounts to be sensed for the six thrust jacks 14*a* to 14*f* that undergo stroke control, which determines the position and attitude of the forward section 11 with respect to the rear section 13.

As shown in FIGS. 5A and 5B, the pressure sensors 17*a* to 17*h* (head-side sensors 17*aa* to 17*fa*, bottom-side sensors 17*ab* to 17*fb*, head-side sensors 17*ga* and 17*ha*, and bottom-side sensors 17*gb* and 17*hb*) are attached to all eight of the thrust jacks 14*a* to 14*h*.

That is, the pressure sensors 17*a* to 17*h* are made up of the head-side sensors 17*aa* to 17*fa* and the bottom-side sensors 17*ab* to 17*fb* that are attached to the six thrust jacks 14*a* to 14*f* that undergo stroke control, and the head-side sensors 17*ga* and 17*ha* and the bottom-side sensors 17*gb* and 17*hb* that are attached to the two thrust jacks 14*g* and 14*h* that do not undergo stroke control.

The cylinder pressure of the thrust jacks 14*a* to 14*f* can be found from the pressure differential between the head-side sensors 17*aa* to 17*fa* and the bottom-side sensors 17*ab* to 17*fb*. Similarly, the cylinder pressure of the thrust jacks 14*g* and 14*h* can be found from the pressure differential between the head-side sensors 17*ga* and 17*ha* and the bottom-side sensors 17*gb* and 17*hb*.

This makes it possible to sense the external force that is exerted on the eight thrust jacks 14*a* to 14*h* that undergo allocation force control.

With the above configuration, the grippers 13*a* are pressed against the side walls T1*a* of the first tunnel T1, so the cutter head 12 on the distal end side is rotated in a state of being supported and not moving through the first tunnel T1, and while this is happening, the thrust jacks 14*a* to 14*h* of the parallel link mechanism 14 are extended to press the cutter head 12 against the working face, allowing the boring machine 10 to move forward and excavate rock and the like. As the boring machine 10 moves, the finely crushed stones and so forth are conveyed to the rear on the conveyor belt 15 or the like. In this way, the boring machine 10 bores its way through the first tunnel T1 (see FIG. 2).

Control Blocks of Boring Machine 10

Figure 4:
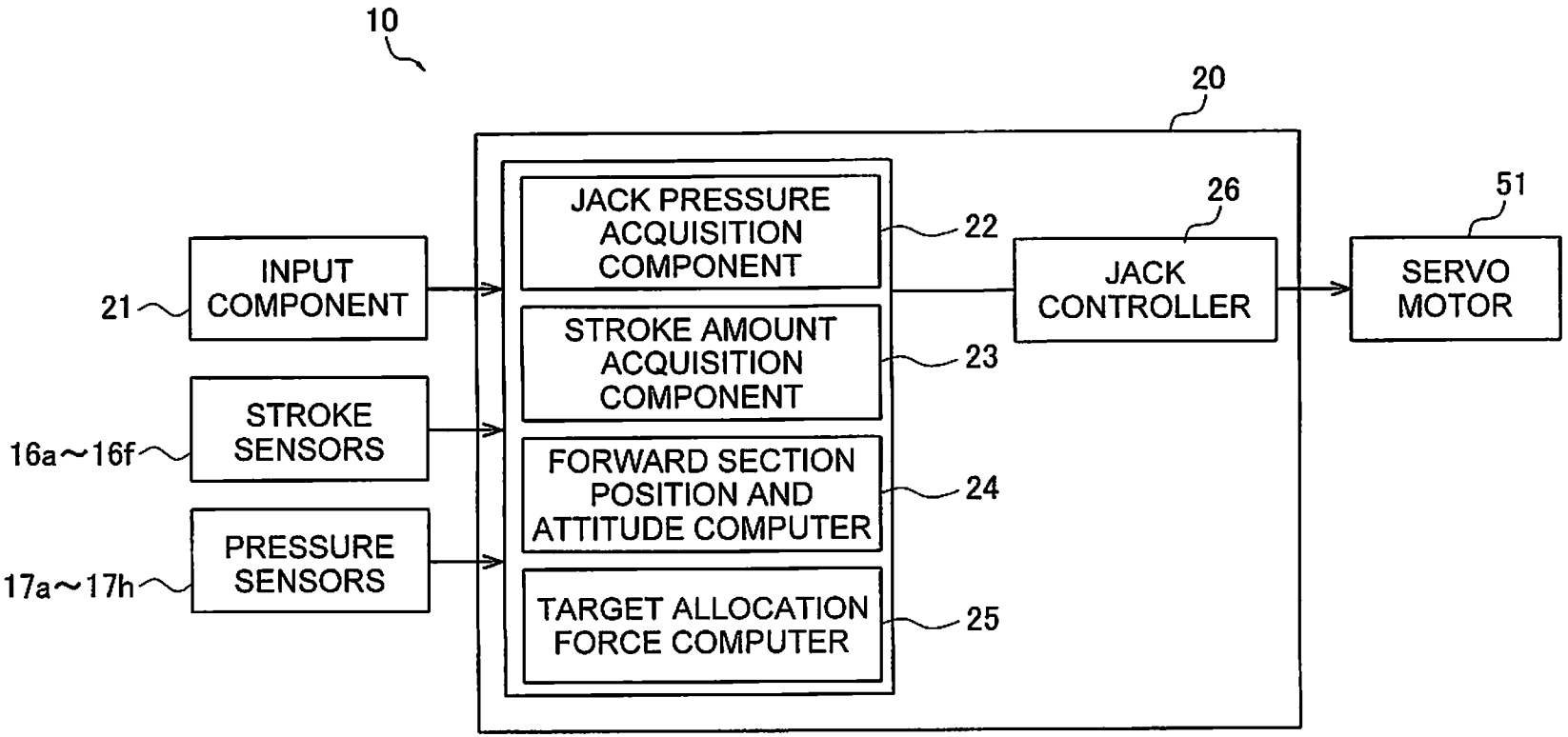
FIG. 4 is a control block diagram of the boring machine in FIG. 1.
Figure 5A:
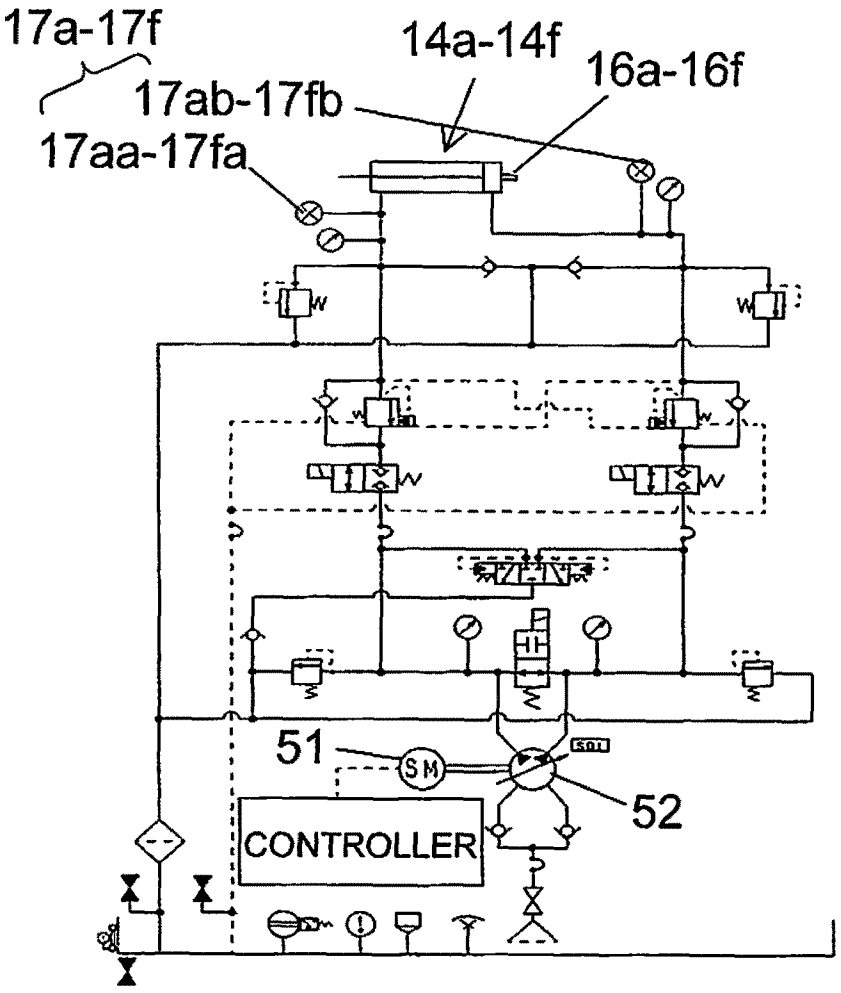
FIG. 5A is a circuit diagram of a thrust jack, used to perform the stroke control shown in FIG. 4.

As shown in FIG. 4, the boring machine 10 in this exemplary embodiment is made up of internal control blocks that include an input component 21, a jack pressure acquisition component 22, a stroke amount acquisition component 23, a forward section position and attitude computer 24, a target allocation force computer 25, and a jack controller 26.

The input component 21 receives control inputs from the operator through a touch panel type of monitor display screen 50 (see FIG. 6) (discussed below). More specifically, when the direction in which the forward section 11 excavates (advances) is controlled manually, various keys 52*a* to 52*d* of a direction input component 52 (see FIG. 6), etc., are used. The operator sets the desired position and attitude of the forward section 11 by making control inputs. When the extend button 53*a* is pressed after setting, the stroke of the thrust jacks 14*a* to 14*f* is controlled so that the forward section 11 will assume the position and attitude that have been set.

The jack pressure acquisition component 22 acquires in real time the cylinder pressures of all eight of the thrust jacks 14*a* to 14*h* that undergo force control. More specifically, the jack pressure acquisition component 22 acquires the sensing results from the pressure sensors 17*a* to 17*h* respectively attached to the eight thrust jacks 14*a* to 14*h*. As discussed above, the sensing results from the pressure sensors 17*a* to 17*h* are found as the difference between the sensing results of the head-side sensors 17*aa* to 17*ha* and the sensing results of the bottom-side sensors 17*ab* to 17*hb*. The difference between the pressure on the head side and the pressure on the bottom side is the axial force of the thrust jacks 14*a* to 14*h*, and indicates the load to which the jacks are subjected.

The stroke amount acquisition component 23 acquires in real time the stroke amounts of the six thrust jacks 14*a* to 14*f* that undergo stroke control. More specifically, the stroke amount acquisition component 23 acquires the sensing results of the stroke sensors 16*a* to 16*f* attached to the six thrust jacks 14*a* to 14*f* that undergo stroke control.

The forward section position and attitude computer 24 computes the relative position and attitude of the forward section 11 with respect to the rear section 13. More specifically, the position of the rear section 13, found by external measurement made using a three-point prism (not shown) once a day, for example, is inputted to the forward section position and attitude computer 24. The relative position and attitude of the forward section 11 with respect to the rear section 13 are computed on the basis of the stroke amounts of the thrust jacks 14*a* to 14*f* obtained by the stroke amount acquisition component 23. Also, the position of the forward section 11 is computed from the measured position of the rear section 13 that has been inputted, and the computed relative position and attitude of the forward section 11 with respect to the rear section 13.

The target allocation force computer 25 computes the magnitude of the external force surmised to be exerted on the eight thrust jacks 14*a* to 14*h*, and the target allocation force of the thrust jacks 14*a* to 14*f* for resisting the six components of this external force, from the position and attitude of the forward section computed by the forward section position and attitude computer 24 and the sensing results of the pressure sensors 17*a* to 17*h* acquired by the jack pressure acquisition component 22.

If there were only six thrust jacks constituting the parallel link mechanism 14, there would be only one combination of target allocation force for the jacks. To put this another way, the target allocation force always coincides with the axial force sense for the jacks. On the other hand, with a mechanism in which there are more than six thrust jacks, as in this exemplary embodiment, there are countless combinations of target allocation force for the jacks. In view of this, the target allocation force of the jacks is computed with a generalized inverse matrix.

More specifically, the target allocation force computer 25 controls the target allocation force of the thrust jacks 14*a* to 14*h* by means of the following computation. The target allocation force computer 25 considers the local x and z axes in a cross section of the forward section 11 and the y axis in the center axis local coordinates of the forward section 11, and finds the unit vectors thereof ($e_x$, $e_y$, and $e_z$) from the position and attitude of the forward section 11 obtained from the forward section position and attitude computer 24.

Next, the unit vectors $e_1$ to $e_8$ of the extension direction of the eight thrust jacks 14*a* to 14*h* are found.

The axis forces of the thrust jacks 14*a* to 1411 obtained by the jack pressure acquisition component 22 are then termed $f_1$ to $f_8$.

The external force F exerted on the forward section 11 at the center axis local coordinates can be computed from the following equation.

$F_x$, $F_y$, and $F_z$ are respectively the x direction, the y direction, and the z direction in the local coordinates. $M_\alpha$, $M_\beta$, and $M_\gamma$ are respectively the moment around the z axis, the y axis, and the x axis in the local coordinates. F means the external force exerted on the forward section 11.

f is a matrix expressed by:

$$f=(f_1,f_2,f_3,f_4,f_5,f_6,f_7,f_8)T$$

The symbols $f_1$ to $f_8$ are the sensed axial forces of the thrust jacks 14*a* to 14*h*.

W is a transformation matrix, and has the following elements.

The symbol $e_{ij}$ indicates the inner product of the unit vectors of the axial extension directions of the thrust jacks 14*a* to 14*h* and the unit vectors of the local coordinate axial directions. The inner product of $e_i$ (i=1 to 8) and ($e_x$, $e_y$, $e_z$) is calculated and resolved into the components of the local xyz axes. More specifically:

$e_1 \cdot e_x = e_{1x}$: the force component Fx direction in the $e_x$ direction when the thrust jack 14*a* has a force 1

$e_1 \cdot e_y = e_{1y}$: the force component Fy direction in the $e_y$ direction when the thrust jack 14*a* has a force 1

$e_1 \cdot e_z = e_{1z}$: the force component Fz direction in the $e_z$ direction when the thrust jack 14*a* has a force 1

$e_{1x}y_1 - e_{1y}x_1$: the component $M_\alpha$ (=$F_4$) direction acting as the moment around the z axis when the thrust jack 14*a* has a force 1

$e_{1x}z_1 - e_{1z}x_1$: the component $M_\beta$ (=$F_5$) direction acting as the moment around the y axis when the thrust jack 14*a* has a force 1

$e_{1z}y_1 - e_{1y}z_1$: the component $M_\gamma$ (=$F_6$) direction acting as the moment around the x axis when the thrust jack 14*a* has a force 1

If there are only six thrust jacks constituting the parallel link mechanism 14, the force components of the axial directions of the various jacks based on the external force F computed from the above equation will match the sensed axial forces $f_1$ to $f_6$. However, if more than six jacks make up the link mechanism 14, the computed external force will not match the sensed axial forces.

For example, with an eight-jack configuration, the position and attitude of the forward section 11 are determined by the stroke length of six of the jacks, and the remaining two jacks may have a stroke length that is shorter than the stroke length corresponding to the position and attitude thereof. In this case, despite the fact that an external force is exerted on the forward section 11, the sensed axial force for the other two jacks is zero.

[First Mathematical Formula]

$$\begin{pmatrix} F_x \\ F_y \\ F_z \\ M_\alpha \\ M_\beta \\ M_\gamma \end{pmatrix} = \begin{pmatrix} e_{1x} & e_{2x} & e_{3x} & e_{4x} & e_{5x} & e_{6x} & e_{7x} & e_{8x} \\ e_{1y} & e_{2y} & e_{3y} & e_{4y} & e_{5y} & e_{6y} & e_{7y} & e_{8y} \\ e_{1z} & e_{2z} & e_{3z} & e_{4z} & e_{5z} & e_{6z} & e_{7z} & e_{8z} \\ e_{1x}y_1 \cdot e_{1y}x_1 & e_{2x}y_2 \cdot e_{2y}x_2 & e_{3x}y_3 \cdot e_{3y}x_3 & e_{4x}y_4 \cdot e_{4y}x_4 & e_{5x}y_5 \cdot e_{5y}x_5 & e_{6x}y_6 \cdot e_{6y}x_6 & e_{7x}y_7 \cdot e_{7y}x_7 & e_{8x}y_8 \cdot e_{8y}x_8 \\ e_{1x}z_1 \cdot e_{1z}x_1 & e_{2x}z_2 \cdot e_{2z}x_2 & e_{3x}z_3 \cdot e_{3z}x_3 & e_{4x}z_4 \cdot e_{4z}x_4 & e_{5x}z_5 \cdot e_{5z}x_5 & e_{6x}z_6 \cdot e_{6z}x_6 & e_{7x}z_7 \cdot e_{7z}x_7 & e_{8x}z_8 \cdot e_{8z}x_8 \\ e_{1z}y_1 \cdot e_{1y}z_1 & e_{2z}y_2 \cdot e_{2y}z_2 & e_{3z}y_3 \cdot e_{3z}z_3 & e_{4z}y_4 \cdot e_{4z}z_4 & e_{5z}y_5 \cdot e_{5y}z_5 & e_{6z}y_6 \cdot e_{6y}z_6 & e_{7z}y_7 \cdot e_{7y}z_7 & e_{8z}y_8 \cdot e_{8y}z_8 \end{pmatrix} \begin{pmatrix} f_1 \\ f_2 \\ f_3 \\ f_4 \\ f_5 \\ f_6 \\ f_7 \\ f_8 \end{pmatrix}$$

Here, F is a matrix expressed by:

$$F=(F_x,F_y,F_z,M_\alpha,M_\beta,M_\gamma)T$$

In view of this, the allocation of component directions is presumed from the ratio of the row elements in the transformation matrix W and the six components of the computed external force F, and a target allocation force is found that is the force components in the axial directions of the various jacks corresponding to the external force.

Since the transformation matrix W is not regular, a generalized inverse matrix is used to compute the target allocation force. A generalized inverse matrix makes use of a pseudo inverse matrix (a Moore-Penrose inverse matrix). That is, a pseudo inverse matrix $W^+$ (an 8×6 matrix) that will result in $W^+F=f'$ is found from F=Wf, and the target allocation force f' (an 8×1 matrix) that results in the least squares solution. This allows the target allocation force to be computed at the minimum norm.

Of these eight components, the value of the components for the two thrust jacks 14*g* and 14*h* that do not undergo stroke control shall be termed fpj.

The jack controller 26 controls the force exerted on the thrust jacks 14*g* and 14*h* included in the parallel link mechanism 14 on the basis of the target allocation force of the eight thrust jacks 14*a* to 14*h* computed by the target allocation force computer 25, and also performs stroke control on the other six thrust jacks 14*a* to 14*f*. Performing force control on the two thrust jacks 14*g* and 14*h* with the target allocation force obtained by the above-mentioned computation makes the load to which the other thrust jacks 14*a* to 14*f* are subjected from external force be the same as (or substantially the same as) the target allocation force obtained by the above-mentioned computation.

Consequently, during tunnel excavation work, even when there is a change in the direction or magnitude of the external force exerted on the boring machine 10 due to a change in the rock characteristics, etc., allocation force control can be performed on the two thrust jacks 14*g* and 14*h*, and stroke control can be performed on the six thrust jacks 14*a* to 14*f*, allowing changes in external force to be handled properly. Thus, the system can accommodate the excavation of shafts and the like that include curved portions with a small radius of curvature R, at which the magnitude or orientation of external force is likely to change.

Monitor Display Screen 50

Figure 6:
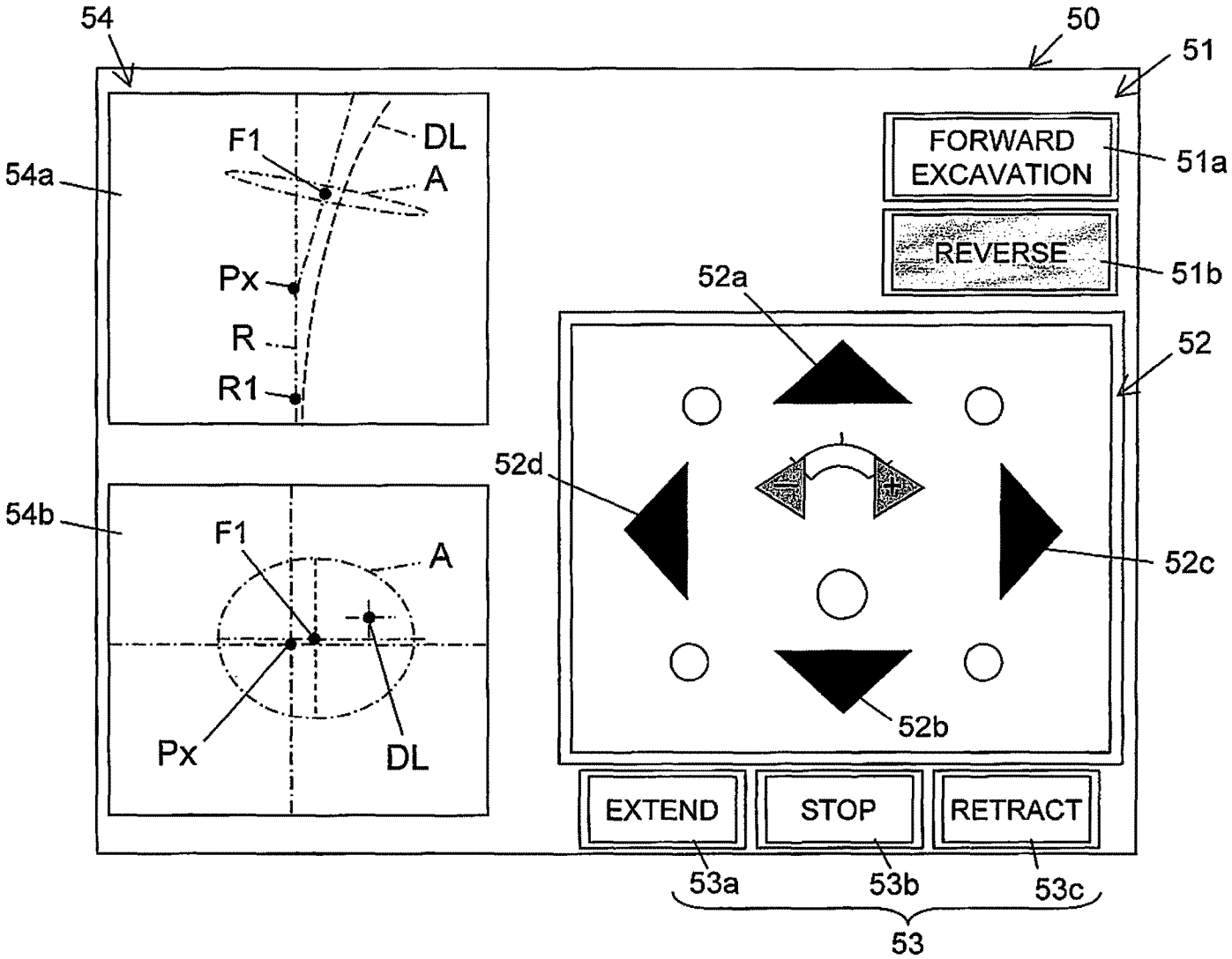
FIG. 6 is a diagram of the display screen of a monitor on which control inputs are made for the boring machine in FIG. 1.

As shown in FIG. 6, the boring machine 10 in this exemplary embodiment makes use of a touch panel type of monitor display screen 50 as the input component 21 that receives control inputs from the operator. In this exemplary embodiment, as the interface for inputting the excavation target position, three points in the up and down direction, the left and right direction, and the forward direction can be inputted through the monitor display screen 50.

As shown in FIG. 6, a forward and reverse excavation setting component 51, the direction input component 52, a jack control component 53, and a forward section position and attitude display component 54 are displayed on the monitor display screen 50.

The forward and reverse excavation setting component 51 is a switch for switching the movement direction (forward and reverse) of the boring machine 10, and has a forward excavation button 51*a* and a reverse button 51*b*.

The forward excavation button 51*a* is pressed to make the boring machine 10 go forward. When the forward excavation button 51*a* is pressed, the cutter head 12, the grippers 13*a* of the rear section 13, and the parallel link mechanism 14 are controlled so that the boring machine 10 will move forward.

The reverse button 51*b* is pressed to make the boring machine 10 reverse along the tunnel when tunnel excavation up to the desired position is complete, etc. When the reverse button 51*b* is pressed, the grippers 13*a* of the rear section 13 and the parallel link mechanism 14 are controlled so that the boring machine 10 will move rearward.

The direction input component 52 is operated by the operator when deviation occurs in the progress of excavation toward the target position, and has a plurality of directional buttons (an up button 52*a*, a down button 52*b*, a right button 52*c*, and a left button 52*d*).

The up button 52*a*, down button 52*b*, right button 52*c*, and left button 52*d* are pressed in the proper direction while the operator checks the position and attitude of the forward section. Consequently, the operator can control the boring machine 10 so that it excavates toward the target position, merely by intuitively operating the proper buttons while looking at the forward section position and attitude display component 54.

The jack control component 53 is a control input component for setting the operation of the eight thrust jacks 14*a* to 14*h* included in the parallel link mechanism 14, and has an extend button 53*a*, a stop button 53*b*, and a retract button 53*c*.

The extend button 53*a* is used to drive the thrust jacks 14*a* to 14*h* in the direction in which they extend. The stop button 53*b* is used to stop the movement of the thrust jacks 14*a* to 14*h*. The retract button 53*c* is used to drive the thrust jacks 14*a* to 14*h* in the direction in which they retract.

The forward section position and attitude display component 54 displays the position and attitude of the forward section 11 with respect to the rear section 13, and the designed excavation line. The forward section position and attitude display component 54 also has a first display component 54*a* and a second display component 54*b*.

The first display component 54*a* displays the center position R1 and center line R of the rear section 13, the center position (forward section origin) F1, center line F, and attitude A of the forward section 11, the articulation point P1 of the boring device, and the designed excavation line DL. The articulation point P1 here is the intersection between the center line R of the rear section 13 and the center line F of the forward section. In the example shown in FIG. 6, the center position F1 of the forward section 11 is shown deviating to the right with respect to the rear section 13.

The second display component 54*b* displays the direction in which the center position of the forward section 11 is deviating in front view (up, down, left, or right), using the articulation point P1 as the center position. In the example shown in FIG. 6, the center position of the forward section 11 is shown deviating to the right and slightly upward with respect to the center position of the rear section 13.

In this exemplary embodiment, the following operation can be performed when the operator sends a control input to the monitor display screen 50 shown in FIG. 6.

More specifically, when the forward excavation button 51*a* is ON and the extend button 53*a* is pressed, the grippers 13*a* of the rear section 13 are deployed toward the side walls of the tunnel, the grippers 11*a* of the forward section 11 are not deployed, and the six thrust jacks 14*a* to 14*f* that undergo stroke control are driven in the direction in which they extend. This allows just the forward section 11 to move forward, while the rear section 13 remains in the same position.

When the forward excavation button 51*a* is ON and the retract button 53*c* is pressed, the grippers 13*a* of the rear section 13 are not deployed, and the grippers 11*a* of the forward section 11 are deployed toward the side walls, and in this state the six thrust jacks 14*a* to 14*f* are driven in the direction in which they retract. This allows the position of the rear section 13 to be moved forward in the excavation direction, while the forward section 11 remains in the same position.

Furthermore, when the reverse button 51*b* is ON and the extend button 53*a* is pressed, the grippers 13*a* of the rear section 13 are not deployed, and the grippers 11*a* of the forward section 11 are deployed, and in this state the six thrust jacks 14*a* to 14*f* are driven in the direction in which they extend. This allows just the rear section 13 to be reversed, while the forward section 11 remains in the same position.

When the reverse button 51*b* is ON and the retract button 53*c* is pressed, the grippers 13*a* of the rear section 13 are deployed, and the grippers 11*a* of the forward section 11 are not deployed, and in this state the six thrust jacks 14*a* to 14*f* are driven in the direction in which they retract. This allows just the forward section 11 to be reversed, while the rear section 13 remains in the same position.

Method for Controlling Boring Machine 10

Figure 7:
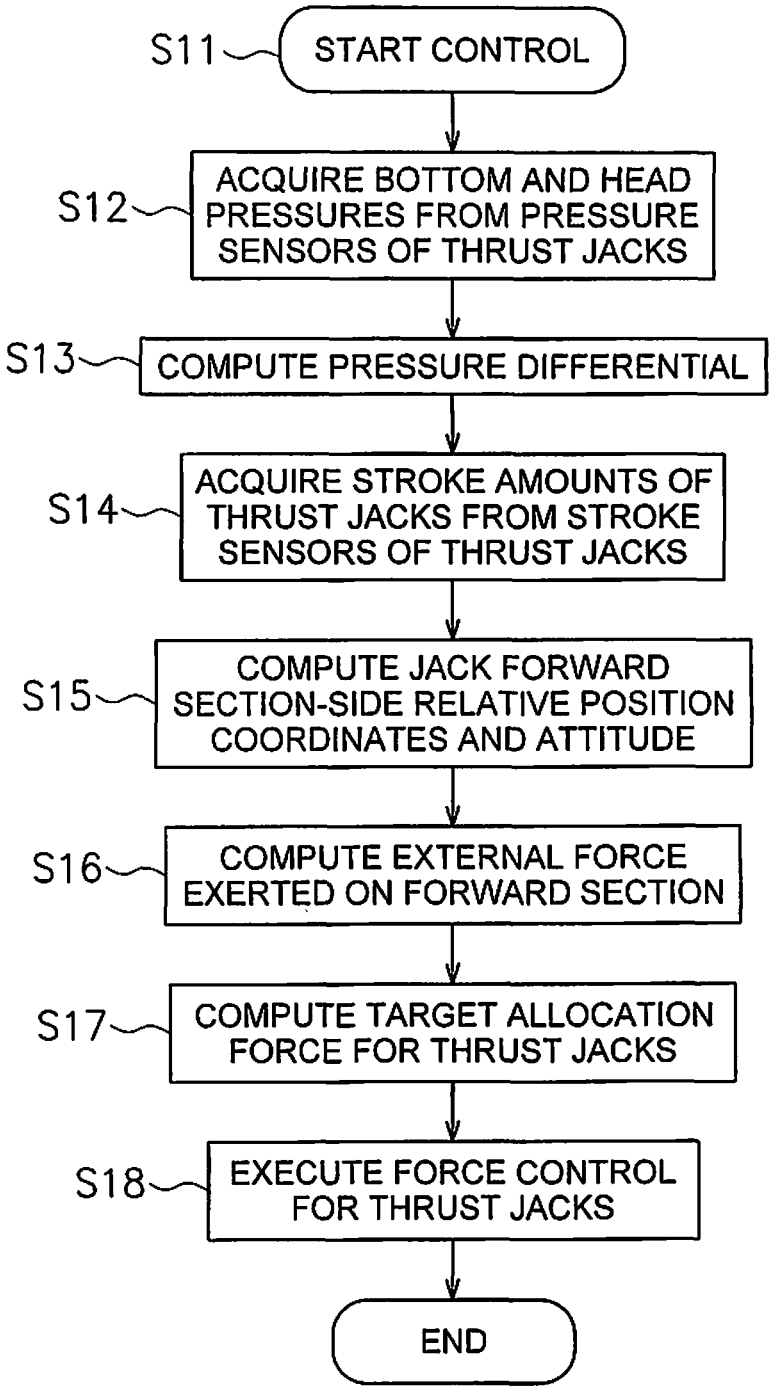
FIG. 7 is a flowchart of allocation force control during tunnel excavation with the boring machine in FIG. 1.

The method for controlling the boring machine 10 in this exemplary embodiment will now be described through reference to the flowchart in FIG. 7.

With the boring machine 10 in this exemplary embodiment, even when a change in the rock characteristics or the like along a curve set on the basis of a design drawing (the designed excavation line), for example, causes a large change in the external force exerted on the boring machine 10, the allocation force control discussed below is executed to allow the proper handling of external forces from all directions (up, down, left, and right).

More specifically, first, control is commenced in step S11, and bottom and head pressures sensed by the pressure sensors 17*a* to 17*h* (see FIGS. 5*a* and 5*b*) attached to all eight of the thrust jacks 14*a* to 14*h* are acquired in step S12.

Next, in step S13, the pressure differential is found from the bottom and head pressures at the thrust jacks 14*a* to 14*h* found in step S12. This makes it possible to obtain the load exerted on the thrust jacks 14*a* to 14*h*.

Next, in step S14, of the eight thrust jacks 14*a* to 14*h*, the stroke amounts of the six thrust jacks 14*a* to 14*f* that undergo stroke control are acquired from the stroke sensors 16*a* to 16*f* respectively attached to these thrust jacks 14*a* to 14*f*.

Next, in step S15, the relative position coordinates and attitude of the forward section 11 with respect to the rear section 13 are computed. The relative position coordinates of the forward section 11 with respect to the rear section 13 refers to the position coordinates of the forward section 11 using the articulation point P1 of the boring device as a reference. The attitude of the rear section 13 is computed from interpolation from the stroke amounts of the thrust jacks 14*a* to 14*f*.

As discussed above, the absolute position coordinates of the forward section 11 can be found by first finding the position of the rear section 13 by external measurement made using a three-point prism (not shown), for example, and then computing on the basis of the stroke amounts of the thrust jacks 14*a* to 14*f*.

Next, in step S16, the external force to which the forward section 11 is subjected is computed from the force components allocated to the thrust jacks 14*a* to 14*h* in the relative position coordinates of the forward section 11 found by computation in step S15.

Next in step S17, the target allocation force is computed, which is the force allocated to the eight thrust jacks 14*a* to 14*h* to resist the external force computed in S16 to which the forward section 11 is subjected. The computation of the target allocation force here is as described above.

Next in step S18, force control is performed on the thrust jacks 14*g* and 14*h* so that external force will be properly allocated to the eight thrust jacks 14*a* to 14*h* on the basis of the target allocation force found in step S17.

With the boring machine 10 in this exemplary embodiment, of the eight thrust jacks 14*a* to 14*h*, stroke amount control is performed on the six thrust jacks 14*a* to 14*f* by a control method such as that discussed above. On the other hand, the two thrust jacks 14*g* and 14*h* do not undergo stroke amount control, and only undergo force control.

Consequently, in excavating a tunnel that includes curved portions with a small radius of curvature R during the excavation of a shaft as discussed below, for example, even when there should be a change in the direction or magnitude of the external force exerted on the boring machine 10, the excavation can be carried out smoothly by performing control so that the load of the external force is effectively allocated to the eight thrust jacks 14*a* to 14*h*.

Tunnel Excavation Method

The method for excavating with the boring machine 10 pertaining to this exemplary embodiment will now be described through reference to FIG. 8.

Specifically, in this exemplary embodiment, the above-mentioned boring machine 10 is controlled to perform shaft excavation as below.

Figure 8:
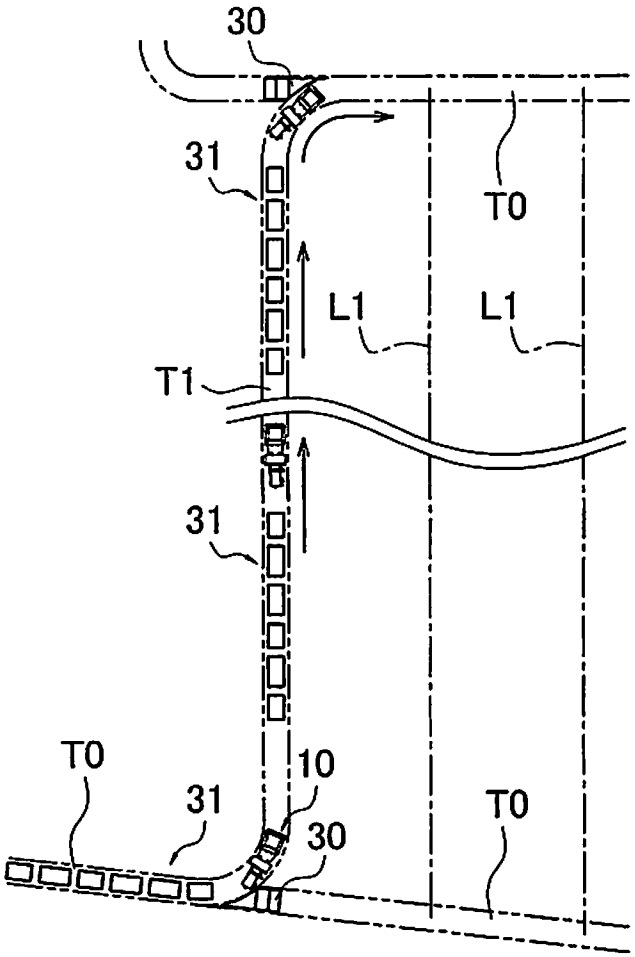
FIG. 8 is a diagram of the procedure for shaft boring using the tunnel boring device in FIG. 1.

FIG. 8 shows the procedure for excavating three first tunnels T1 along three substantially parallel first excavation lines L1, from two existing tunnels T0.

In FIG. 8, the boring machine 10 is equipped with a backup trailer 31 comprising a drive source for the boring machine 10, etc. The state shown here is one in which the boring machine 10 is moved by a tractor to a position that branches from an existing tunnel T0 to a first tunnel T1.

Here, a corner counterforce receiver 30 is installed at portions that branch off from an existing tunnel T0 to a first tunnel T1, where the radius of curvature R is smaller. Consequently, even at curved parts where the radius of curvature R is smaller because of branching off to the first tunnel T1, the boring machine 10 can continue to excavate the first tunnel T1 while the grippers 13*a* are in contact with the corner counterforce receivers 30.

Next, as shown in FIG. 8, the boring machine 10 and the backup trailer 31 are moved while the rock, etc., is excavated by the boring machine 10, along the first excavation line L1. This allows the first tunnel T1 to be formed at the desired location.

Next, when the excavation is completed up to the existing tunnel T0 formed some distance away, and the first tunnel T1 communicates between the two tunnels T0, the boring machine 10 and the backup trailer 31 are backed up by the tractor and returned to their initial locations.

The corner counterforce receivers 30 are installed at portions where the first tunnel T1 meets up with a tunnel T0.

Next, the boring machine 10 is again moved along a first excavation line L1 in order to excavate another first tunnel T1 that is substantially parallel to the first tunnel T1 just excavated.

Next, this procedure is repeated until three first tunnels T1 that are substantially parallel to each other have been excavated.

Consequently, with the boring machine 10 of this exemplary embodiment, when excavating a shaft that includes a curved part with a smaller radius of curvature R, even when there is a change in the direction or magnitude of the external force exerted on the boring machine 10 during excavation, the method for controlling the boring machine 10 discussed above allows the allocation force allocated to the thrust jacks 14*a* to 14*h* to be properly controlled, which allows smooth tunnel excavation to be carried out.

An exemplary embodiment of the present invention was described above, but the present invention is not limited to or by the above exemplary embodiment, and various modifications are possible without departing from the gist of the invention.

In the above exemplary embodiment, an example was given of a boring machine 10 comprising a parallel link mechanism 14 that included eight thrust jacks 14*a* to 14*h*. The present invention is not limited to this, however.

The number of thrust jacks that make up the parallel link mechanism is not limited to eight, and may instead be seven, nine, ten, or the like, that is, (6+n) (n=1, 2, 3, . . . ), or in other words, any number of jacks greater than six.

The appropriate number of thrust jacks will depend on the diameter of the tunnel being excavated. For instance, if the tunnel diameter is less than 10 meters, a suitable number of thrust jacks is from seven to ten.

Figure 9:
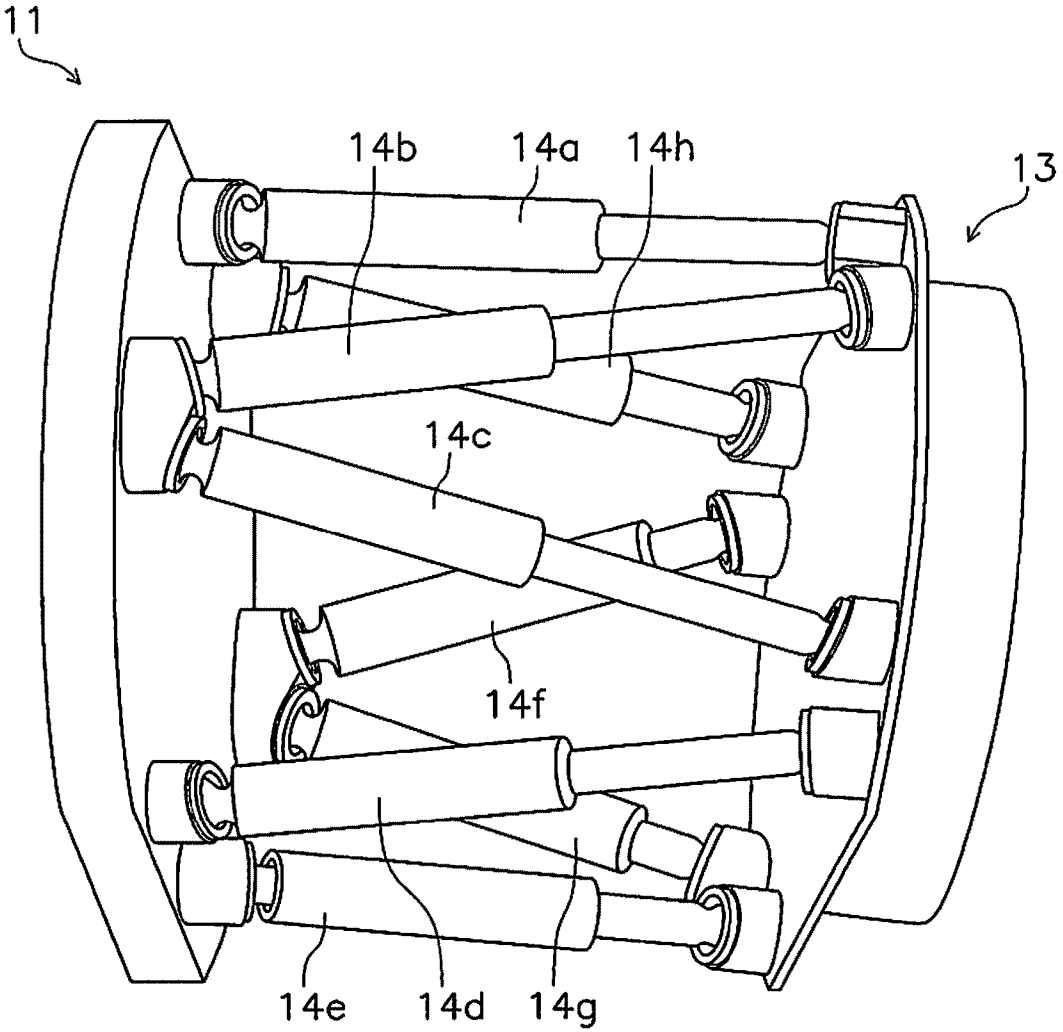
FIG. 9 is a simplified diagram of the layout configuration of the thrust jacks included in the parallel link mechanism of the tunnel boring device pertaining to another exemplary embodiment of the present invention.

In the above exemplary embodiment, an example was given in which thrust jacks 14*g* and 14*h* that underwent only force control were disposed next to each other as shown in FIG. 3, versus the thrust jacks 14*a* to 14*f* that underwent both stroke control and force control. The present invention is not limited to this, however. For instance, as shown in FIG. 9, the thrust jacks 14*g* and 14*h* may be disposed apart from each other.

In the above exemplary embodiment, as discussed above, an example was given in which force control was performed using a value f found as the solution of a least squares method. The present invention is not limited to this, however.

For instance, as below, force control may be performed using allocation from the sum total of the duplicate ratio of the components×the external force component.

Specifically, the target force fpj for the j-th thrust jack can be found as follows.

Second Mathematical Formula $$f_{pj} = \sum_{i=1}^{6} \left( \left( W_{ij} \Big/ \sum_{j=1}^{8} (W_{ij})^2 \right) \times F_i \right)$$

$$(F_1 = F_x \quad F_2 = F_y \quad F_3 = F_z \quad F_4 = M_\alpha \quad F_5 = M_\beta \quad F_6 = M_\gamma)$$

Here again, just as in the above exemplary embodiment, allocation force control can be properly performed on the (6+n) thrust jacks.

In the above exemplary embodiment, an example was given of using the touch panel type of monitor display screen 50 as an interface for receiving control inputs from the operator, but the present invention is not limited to this. For instance, instead of using a touch panel monitor, the operator can make control inputs with a keyboard, mouse, or the like while looking at an ordinary PC screen.

In the above exemplary embodiment, an example was given in which various kinds of control components (the forward and reverse excavation setting component 51, the direction input component 52, the jack control component 53, and the forward section position and attitude display component 54) were disposed on the monitor display screen 50, but the present invention is not limited to this. For instance, some other mode may be employed as the display mode for displaying on the monitor display screen.

In the above exemplary embodiment, in order to sense the external force exerted on the thrust jacks 14*a* to 14*h*, pressure sensors were provided on the head and bottom sides of the jacks, and the differential between the sensed pressures was computed by the controller 20. The present invention is not limited to this, however.

For instance, load cells may be provided to the piston rods of the thrust jacks 14*a* to 14*h* so that the external force is sensed directly.

The tunnel boring device of the present invention comprises a parallel link mechanism that includes (6+n) thrust jacks, wherein the effect of this tunnel boring device is that external forces of all directions and magnitudes produced during excavation can be properly handled, which means that this tunnel boring device can be broadly applied to boring machines that perform tunnel excavation.

The invention claimed is:

1. A tunnel boring device, comprising:

a forward section having a plurality of cutters at an excavation-side surface;

a rear section disposed to a rear of the forward section and having grippers for obtaining counterforce during excavation;

a parallel link mechanism including (6+n) thrust jacks disposed in parallel between the forward section and the rear section, linking the forward section and the rear section, and changing a position and attitude of the forward section with respect to the rear section, where n is a positive integer;

a plurality of stroke sensors attached to the thrust jacks to sense stroke amounts of the thrust jacks;

a plurality of force sensors attached to the thrust jacks to sense a load to which the thrust jacks are subjected; and a controller configured to compute target allocation forces to be allocated to the (6+n) thrust jacks on the basis of sensing results of the plurality of stroke sensors and the plurality of force sensors, and control the thrust jacks so that a stroke control is performed for six of the thrust jacks, and a force control based on respective ones of the target allocation forces is performed for the other n number of the thrust jacks.

2. The tunnel boring device according to claim 1, wherein the controller computes an external force to which the forward section is subjected on the basis of a relative position and an attitude of the forward section with respect to the rear section from the stroke amounts for the six thrust jacks, and a load to which the (6+n) thrust jacks are subjected as sensed by the plurality of force sensors, and computes a target allocation force for each of the thrust jacks in order to resist this external force.

3. The tunnel boring device according to claim 2, wherein the plurality of force sensors are provided to (6+n) of the thrust jacks, and the plurality of stroke sensors are provided to six of the thrust jacks.

4. The tunnel boring device according to claim 2, wherein (6+n) of the thrust jacks are disposed in a substantially circular pattern around an outer peripheral portion of faces where the forward section and the rear section are opposite each other.

5. The tunnel boring device according to claim 2, wherein the controller controls each of the thrust jacks to control an attitude of the forward section three-dimensionally.

6. The tunnel boring device according to claim 2, further comprising an input component configured to receive a control input related to a movement direction of the forward section from an operator, the controller being configured to control a stroke of each of the six of the thrust jacks so that excavation will be performed along a desired radius of curvature set on the basis of the control input when the input component receives the control input from the operator.

7. The tunnel boring device according to claim 6, wherein the input component is a touch panel type of monitor.

8. The tunnel boring device according to claim 7, wherein the monitor has a plurality of directional keys configured to set a movement direction of the forward section, and a display component configured to display a relative position of the forward section with respect to the rear section.

9. The tunnel boring device according to claim 1, wherein the plurality of force sensors are provided to (6+n) of the thrust jacks, and the plurality of stroke sensors are provided to six of the thrust jacks.

10. The tunnel boring device according to claim 1, wherein (6+n) of the thrust jacks are disposed in a substantially circular pattern around an outer peripheral portion of faces where the forward section and the rear section are opposite each other.

11. The tunnel boring device according to claim 1, wherein the controller controls each of the thrust jacks to control an attitude of the forward section three-dimensionally.

12. The tunnel boring device according to claim 1, further comprising an input component configured to receive a control input related to a movement direction of the forward section from an operator, the controller being configured to control a stroke of each of the six of the thrust jacks so that excavation will be performed along a desired radius of curvature set on the basis of the control input when the input component receives the control input from the operator.

13. The tunnel boring device according to claim 12, wherein the input component is a touch panel type of monitor.

14. The tunnel boring device according to claim 13, wherein the monitor has a plurality of directional keys configured to set a movement direction of the forward section, and a display component configured to display a relative position of the forward section with respect to the rear section.

15. A method for controlling a tunnel boring device comprising a forward section having a plurality of cutters on an excavation-side surface, a rear section disposed to a rear of the forward section and having grippers configured to obtain counterforce during excavation, and a parallel link mechanism including (6+n) thrust jacks, where n is a positive integer, that links the forward section and the rear section and changes a position of the forward section with respect to the rear section, the method comprising the steps of:

sensing loads to which the thrust jacks are subjected;

sensing stroke amounts of the thrust jacks;

calculating an external force to which the forward section is subjected on the basis of the sensed stroke amounts and the loads to which the thrust jacks are subjected;

calculating target allocation forces to be allocated to the (6+n) thrust jacks on the basis of the external force; and controlling the thrust jacks so that a stroke control is performed for six of the thrust jacks, and a force control based on a respective ones of the target allocation forces is performed for the other n number of the thrust jacks.

* * * * *